US006618034B1

(12) United States Patent
Sugahara et al.

(10) Patent No.: US 6,618,034 B1
(45) Date of Patent: Sep. 9, 2003

(54) ACTUATED FILM DISPLAY DEVICE

(75) Inventors: Atsushi Sugahara, Yokohama (JP); Richard Lang, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/651,024

(22) Filed: Aug. 30, 2000

(30) Foreign Application Priority Data

Sep. 28, 1999 (JP) ..... 11-274004

(51) Int. Cl.[7] ..... G09G 3/34

(52) U.S. Cl. ..... 345/109; 345/105; 345/84; 345/85; 345/89; 345/7; 345/48

(58) Field of Search ..... 345/108–9, 85, 345/7, 48, 84, 89; 340/815.62; 359/223, 224.7; 348/740, 750

(56) References Cited

U.S. PATENT DOCUMENTS

| | | | | |
|---|---|---|---|---|
| 3,553,364 A | | 1/1971 | Lee | |
| 3,897,997 A | | 8/1975 | Kalt | |
| 3,989,357 A | | 11/1976 | Kalt | |
| 4,194,189 A | * | 3/1980 | Lewiner et al. | 340/373 |
| 4,248,501 A | | 2/1981 | Simpson | |
| 4,704,707 A | | 11/1987 | Simpson | |
| 5,579,149 A | * | 11/1996 | Moret et al. | 345/109 |
| 5,943,033 A | | 8/1999 | Sugahara et al. | |
| 6,317,108 B1 | * | 11/2001 | Kalt | 340/905 |
| 6,329,967 B1 | * | 12/2001 | Little et al. | 345/102 |
| 6,356,254 B1 | * | 3/2002 | Kimura | 345/108 |

FOREIGN PATENT DOCUMENTS

| | | |
|---|---|---|
| DE | 30 47 495 | 7/1982 |
| JP | 4-199084 | 7/1992 |
| JP | 11-95693 | 4/1999 |

OTHER PUBLICATIONS

Patent Abstracts of Japan, JP 11 095693, Apr. 9, 1999.

* cited by examiner

*Primary Examiner*—Bipin Shalwala
*Assistant Examiner*—Leonid Shapiro
(74) *Attorney, Agent, or Firm*—Oblon, Spivak, McClelland, Maier & Neustadt, P.C.

(57) ABSTRACT

An actuated film display device comprises a first fixed electrode, a first movable film electrode, which is placed to face the first fixed electrode to form a first optical path on an opposing side to the first fixed electrode, and which has a fixed end and a movable end, the movable end being displaced toward the first fixed electrode by application of a first potential difference between the first fixed electrode and the first movable film electrode, thereby shutting off the first optical path, a second fixed electrode placed at a predetermined distance from the first fixed electrode, and a second movable film electrode, which is placed to face the second fixed electrode to form a second optical path on an opposing side to the second fixed electrode, which has a fixed end and a movable end, the movable end being displaced toward the second fixed electrode by application of a second potential difference between the second fixed electrode and the second movable film electrode, thereby shutting off the second optical path. The display device having the above-described optical shutter as one pixel can display gray scale without using numerous signal lines and scanning lines.

5 Claims, 10 Drawing Sheets

ACTUATED FILM DISPLAY DEVICE

CROSS-REFERENCE TO RELATED APPLICATIONS

This application is based upon and claims the benefit of priority from the prior Japanese Patent Application No. 11-274004, filed Sep. 28, 1999, the entire contents of which are incorporated herein by reference.

BACKGROUND OF THE INVENTION

The present invention relates to an actuated film display device.

In large display devices and portable display devices, it has recently been desired that the power consumption is lowered. As the display device attaining the low power consumption, known is an actuated film display device using a movable film shutter in which a movable film is driven by an electrostatic force.

The fundamental structure of the actuated film display device is disclosed in Japanese Patent Application Publication No. 11-95693 (U.S. Pat. No. 6,239,777 B1), the contents of which are incorporated herein by reference. In this disclosure, gray scale display is attained by selectively driving sub pixels constituting one pixel. However, for the gray scale display in the actuated film display device mentioned above, a large number of signal lines and scanning lines are required when a plurality of sub pixels of one pixel are selectively turned on and off. To drive the signal lines and scanning lines, a large number of driving ICs are required. Furthermore, since a plurality of driving ICs are arranged in the display device, the size of the device is inevitably enlarged. In the circumstances, an actuated film display device capable of displaying the gray scale in a simple structure has been desired.

BRIEF SUMMARY OF THE INVENTION

An object of the present invention is to provide an actuated film display device capable of displaying gray scale by a simple driving circuit.

To attain the object, there is provided an actuated film display device according to a first aspect of the present invention comprising:

a first fixed electrode;

a first movable film electrode, which is placed to face the first fixed electrode to form a first optical path on an opposing side to the first fixed electrode, and which has a fixed end and a movable end, the movable end being displaced toward the first fixed electrode by application of a first potential difference between the first fixed electrode and the first movable film electrode, thereby shutting off the first optical path;

a second fixed electrode placed at a predetermined distance from the first fixed electrode; and a second movable film electrode, which is placed to face the second fixed electrode to form a second optical path on an opposing side to the second fixed electrode, which has a fixed end and a movable end, the movable end being displaced toward the second fixed electrode by application of a second potential difference different from the first potential difference between the second fixed electrode and the second movable film electrode, thereby shutting off the second optical path.

The actuated film display device is desirably constituted as follows:

A distance between the fixed end and the movable end of the first movable film electrode differs from a distance between the fixed end and the movable end of the second movable film electrode.

A thickness of the first movable film electrode differs from a thickness of the second movable film electrode.

A distance between the first fixed electrode and the fixed end of the first movable film electrode differs from a distance between the second fixed electrode and the fixed end of the second movable film electrode.

The display device further comprises a plurality of pixels, each pixel including a pair of the first fixed electrode and the first movable film electrode and a pair of the second fixed electrode and the second movable film electrode.

Each of the first and second fixed electrodes comprises a light guiding portion which is formed of a transparent material and has a curved surface which faces a corresponding one of the first and second movable film electrodes, and an electrode formed of a transparent conductive layer and formed on the curved surface.

The display device further comprises an insulating layer covering the conductive layer.

The first and second fixed electrodes are plate-form electrodes each of which faces a corresponding one of the first and second movable film electrodes so as to form a light guiding portion therebetween.

The display device further comprises an insulating layer covering at least a tip portion of each of the first and second fixed electrodes.

The display device further comprises a light source arranged at a side of the fixed end of the movable film electrode.

According to a second aspect of the present invention, there is provided an actuated film display device comprising:

a fixed electrode formed by insulatively stacking a plurality of conductive layers different in length, in order of length, while the conductive layers are trued up at one end;

a light-shield movable film electrode, which is placed so as to face a surface of the fixed electrode having the shortest one of the conductive layers formed thereon, and which has a fixed end fixed at the one end of the conductive layers and a movable end; and a potential supply circuit for supplying different potentials to the conductive layers of the fixed electrode, respectively.

According to a third aspect of the present invention, there is provided an actuated film display device comprising:

a plurality of optical shutter sets arranged in rows and columns, each of the optical shutter set comprising at least two optical shutter units different in applied voltage/displacement characteristics, each of the at least two optical shutter units being formed of a fixed electrode and a light-shield cantilever-type movable film electrode fixed at one end; and a first driving circuit for supplying a driving signal to the optical shutter sets arranged in each of the rows; and a second driving circuit for supplying a driving signal to the optical shutter sets arranged in each of the columns;

wherein the first driving circuit supplies a first potential to the fixed electrode of the optical shutter units in each of the rows; and the second driving circuit supplies a second potential to the movable film electrode of the optical shutter units in each of the columns.

According to the present invention, the gray scale can be displayed by the movable film display device without using numerous signal lines and scanning lines. Therefore, it is not necessary to use a large number of driving ICs for driving the numerous signal line and scanning lines. As a result, cost can be reduced. Furthermore, the display device can be reduced in size.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Prior to the explanation of embodiments, the prior art will be explained with reference to some of the disclosures of Japanese Patent Application KOKAI publication No. 11-95653.

Figure 1:
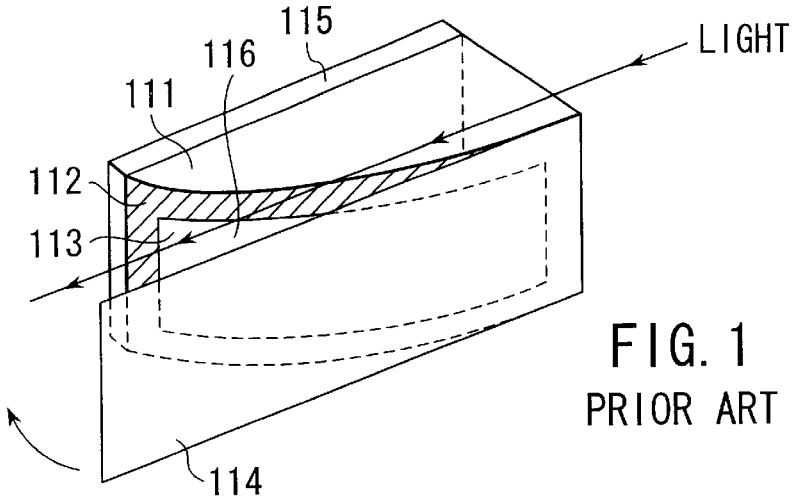
FIG. 1 PRIOR ART
FIG. 1 is a perspective view for one unit of an optical shutter of a conventional actuated film display device.

FIG. 1 is a perspective view of one shutter unit constituting a movable film shutter. The shutter unit comprises a transparent light guiding body 111, a black matrix 112 which is a light shield portion arranged on a curved surface of the transparent light guiding body 111, an opening portion 113 surrounded by the black matrix 112, a light-shield movable film 114 arranged so as to face the opening portion 113 of the transparent light guiding body 111, and a light shielding board 115 arranged so as to face the movable film 114 with the transparent light guiding body 111 sandwiched between them. The light shield board 115 may be a reflective board.

Light is incident on the transparent light guiding body 111 in the direction indicated by an arrow and passes through it. For gray scale display, one pixel is constituted of a plurality of transparent light guiding bodies 111. In an arbitrary number of the transparent light guiding bodies 111, the movable film 114 is bent to change the area covering the opening portion 113. Since the amount of light emitted from the opening portion 113 can be changed in this manner, the gray scale can be displayed.

The surface of the opening portion of the transparent light guiding body 111 is made conductive, so that it works as a fixed electrode 116. The movable film 114 is made conductive, so that it works a movable electrode. Since a transparent insulating film (not shown) is formed on the surface of the fixed electrode, a short circuit between the movable electrode and the fixed electrode can be prevented.

Figure 2A:
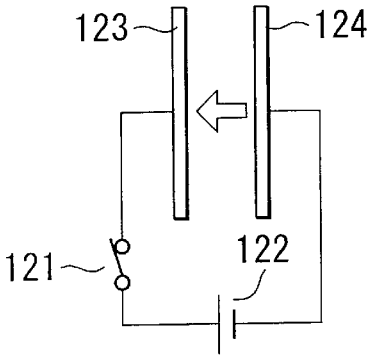
FIG. 2A PRIOR ART
FIG. 2A is an illustration for explaining a principle of the optical shutter.
Figure 2B:
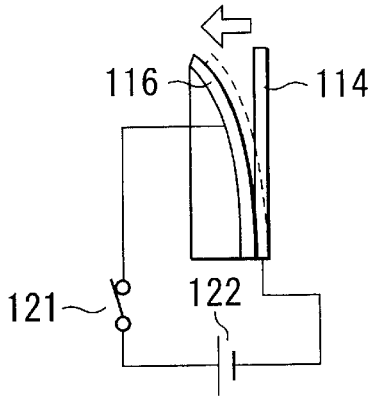
FIG. 2B PRIOR ART
FIG. 2B is an illustration for explaining a principle of the movable film shutter.

Next, the principle how the movable film 114 is displaced will be explained. As shown in FIG. 2A, when a switch 121 is turned on to apply a voltage from a power source 122 between two electrodes 123 and 124, an electrostatic force is generated between the two electrodes. In this case, if these two electrodes are replaced with the movable electrode (movable film) 114 and the fixed electrode 116 formed on the surface of the transparent light guiding body as shown in FIG. 2B and a voltage is applied between them, the movable film 114 is bent as indicated by a broken line and covers the fixed electrode 116. The movable film 114 has a light shield property. Therefore, a light is transmitted when no voltage is applied, whereas the light is shut out when the movable film 114 is bent upon an application of a voltage.

Figure 2C:
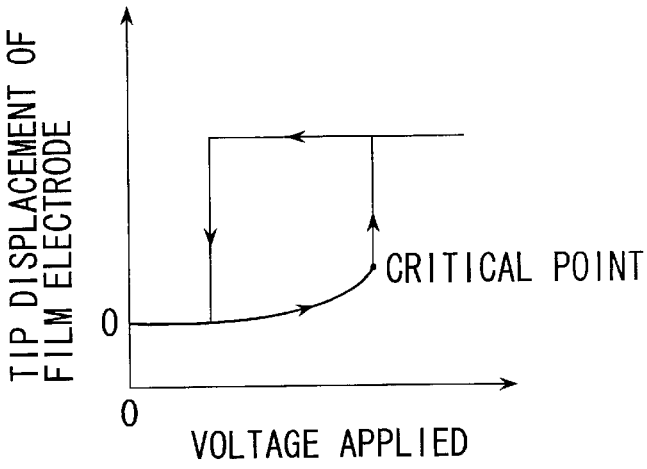
FIG. 2C PRIOR ART
FIG. 2C is a characteristic illustration for explaining hysteresis characteristics of the actuated film display device.

FIG. 2C shows the relationship between the applied voltage and the tip displacement of the movable film when, the movable film is bent by a voltage application. In FIG. 2C, the tip of the movable film is gradually displaced with an increase of the voltage. When a displacement amount reaches to a critical point, the tip is suddenly displaced and reaches the maximum displacement amount. At the maximum displacement amount, the movable film is in tight contact with the surface insulating film of the fixed electrode. Therefore, even if the voltage is further increased, the displacement amount is not increased. In contrast, if the voltage is reduced, the displacement amount is not reduced for a while. This is because even if two electrodes want to separate, an electrostatic force between the electrodes prevents the separation. Therefore, no displacement occurs until an elastic force of the movable film exceeds the electrostatic force. In this sense, the movable film displacement has so-called hysteresis characteristics.

Now, the actuated film display device using a movable film shutter having hysteresis characteristics will be explained.

Figure 3:
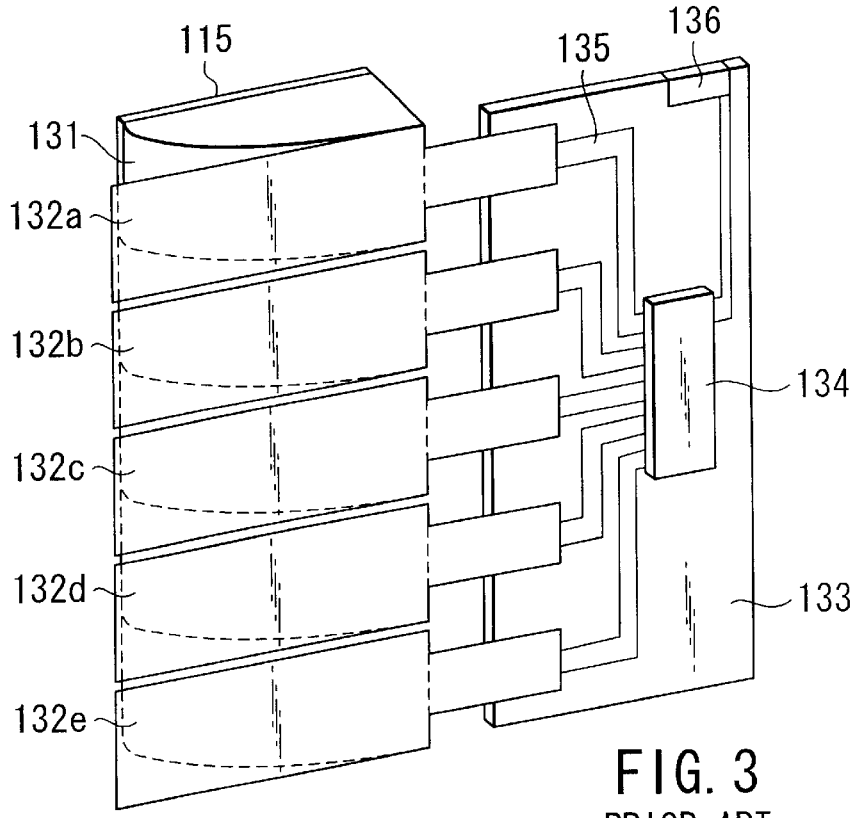
FIG. 3 PRIOR ART
FIG. 3 is a schematic view showing a basic structure of the conventional actuated film display device.

As shown in FIG. 3, a plurality of movable film electrodes 132*a*–132*e* are arranged so as to face one transparent light guiding fixed electrode portion 131. A circuit substrate 133 is adjacent to the transparent light guiding fixed electrode portion 131. On the circuit substrate 133, a driving IC 134 is arranged. The movable film electrodes 132*a*–132*e* are connected to the driving IC 134 by way of wirings 135. In a circuit substrate 133, a connecter portion 136 is provided to perform data exchange with an adjacent display device.

Figure 4:
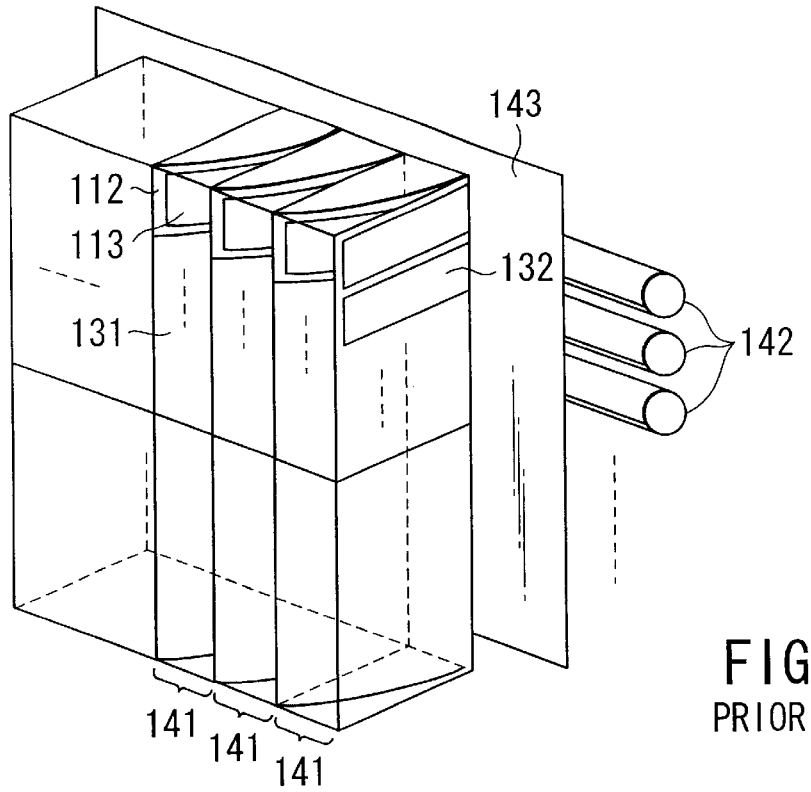
FIG. 4 PRIOR ART
FIG. 4 is a schematic view showing an actuated film display device in which shutter units of FIG. 3 are arranged in a matrix form.

As shown in FIG. 4, the aforementioned movable film shutter units 141 are arranged in the form of a matrix to obtain an actuated film display device having a plurality of shutters arranged in a matrix. In FIG. 4, the light from a fluorescent lamp 142 is dispersed by a dispersion board 143, enters the transparent light guiding fixed electrode portion 131 and is emitted from the opening portion 113 when the opening portion 113 is not covered with the bending movable film electrode 132. In this case, the emitted light is colored by a color filter (not shown).

Figure 5:
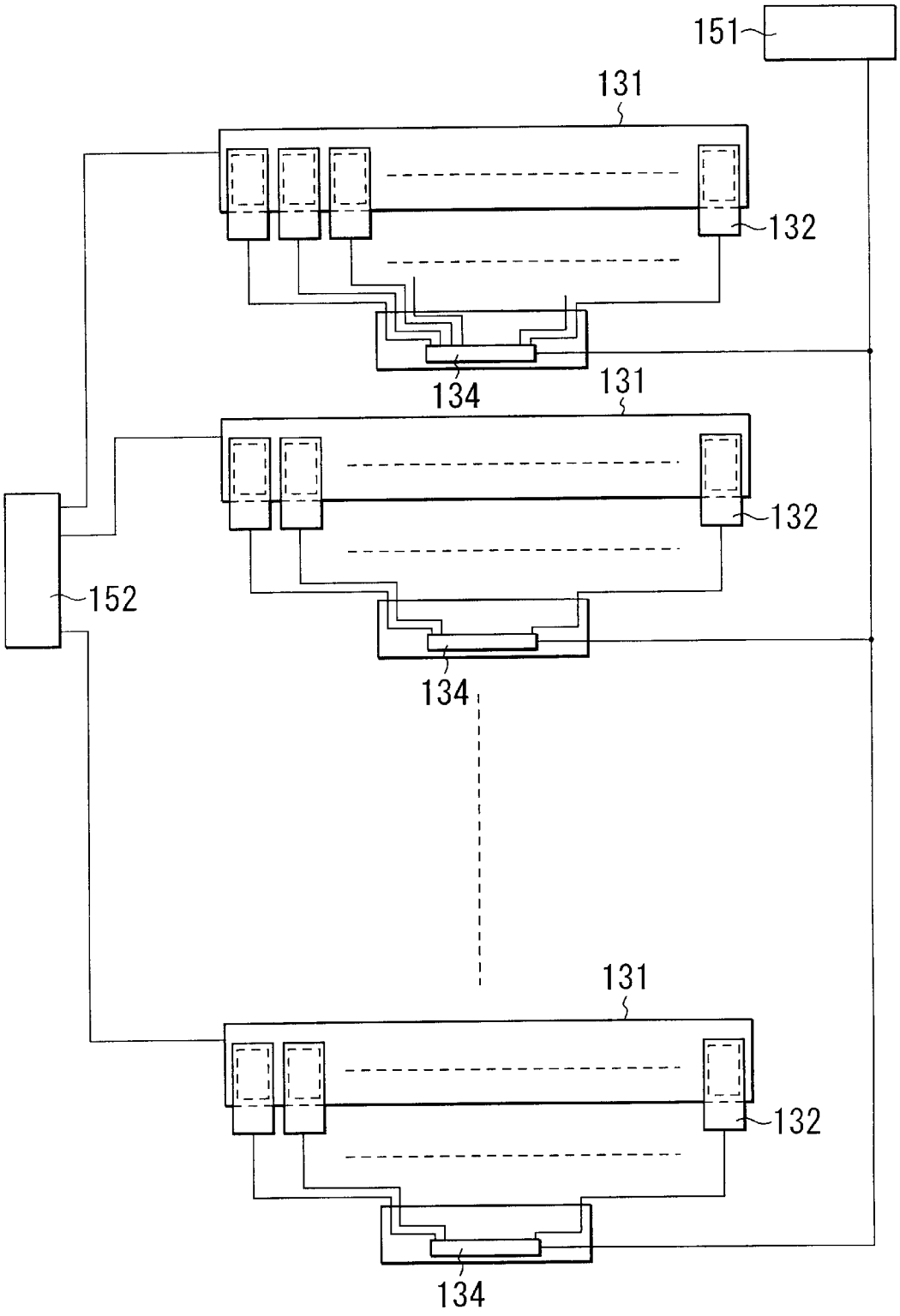
FIG. 5 PRIOR ART
FIG. 5 is a diagram showing how to connect elements of the display device of FIG. 4 for explaining a driving method of the device.

Now, the method of driving the actuated film display device will be explained with reference to a wiring diagram shown in FIG. 5.

In the actuated film display device, the transparent light guiding fixed electrode potion 131 acts as a scanning line. The picture image data sent from a signal source driving circuit 151 is once stored in the driving IC 134 and is transmitted to the movable film electrode 132 as a potential. At this time, if a scanning potential has been given from a scanning line driving IC 152 to the transparent light guiding fixed electrode 131, a potential difference is generated between the fixed electrode 131 and the movable film electrode 132. As a result, the movable film electrode 131 can be bent toward the transparent light guiding fixed electrode 131. If the movable film electrode 132 and the transparent light guiding fixed electrode 131 have the same potential, no attractive force works between the film electrode 132 and the transparent light guiding fixed electrode 131, so that the movable film electrode 132 is separated from the transparent light guiding fixed electrode 131 due to the elastic force of the movable film electrode 132.

Next, there will be explained a conventional method for displaying gray scale using the actuated film display device.

Figure 6:
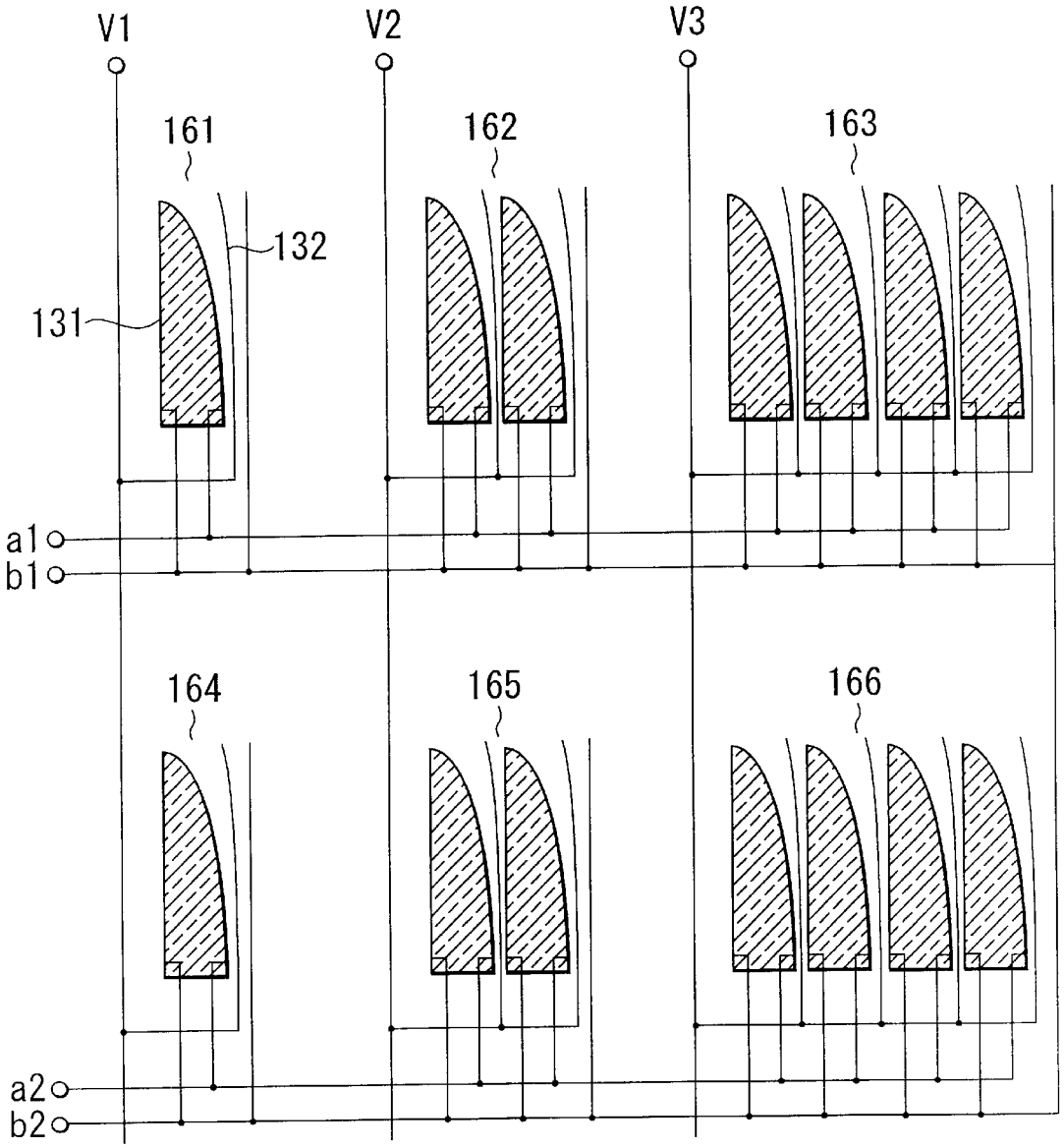
FIG. 6 PRIOR ART
FIG. 6 is a schematic view showing a structure of one pixel attaining gray scale display in the conventional actuated film display device.

FIG. 6 shows one pixel formed of a plurality of movable film shutters. In this example, the single pixel has six sub pixels 161–166 which are arranged in the form of a 3×2 matrix.

The transmitted light amounts of the six sub pixels 161–166 are made different with each other. First, each of the sub pixel 161 and the sub pixel 164 is formed of one movable film shutter. Each of the sub pixel 161 and the sub pixel 165 is formed of two movable film shutters. Each of the sub pixel 163 and the sub pixel 166 is formed of four movable film shutters. Furthermore, the width direction of the movable film shutter is vertical to the surface of the figure. Although not shown in the figure, the width (in the depth direction to the surface of the figure) of each of the film shutters of the sub pixels 161, 162, 163 is narrow, whereas the width (in the depth direction to the surface of the figure) of each of the film.shutters of the sub pixels 164, 165, 166 is wide.

In this case, it is possible to display gray scale by one pixel owing to a plurality of sub pixels (6, in this case). More specifically, the gray scale can be displayed by selectively opening/closing the six sub pixels. This is because the light transmitting area, that is, the transmitted light amount is changed by opening/closing the sub pixels. The principal of this will be described more specifically below.

As shown in FIG. 6, since the movable film electrode 132 is connected to a signal line, any one of voltages V1 to V3 is applied to the electrode. Furthermore, the transparent light guiding fixed electrode portion 131 is connected to scanning lines, an and bn (n=1, 2). As a result, a potential Van (n=1, 2) is applied to the curved surface, whereas a potential Vbn (n=1, 2) is applied to the non-curved surface. Furthermore, a plane electrode is provided at an end of each of the sub pixel opposing to the curved surface. To the plane electrode, Vbn is applied. Therefore, the movable film 132 is sandwiched between the Van-applied electrode and the Vbn-applied electrode and moved by the electrostatic forces applied to both electrodes.

An example of operation of the constitution thus constructed will be explained below. First, positive and negative potentials of the same value are applied respectively to a pair of the scanning lines to be driven. On the other hand, a potential Vn (n=1 to 3) is applied to a signal line depending upon a display signal. At that time, if Vn=0, the movable film electrode 132 is not bent. If Vn≠0, the movable film electrode 132 is bent toward a side having a larger potential difference whichever between Vn and Van or between Vn and Vbn. Furthermore, even after the pair of scanning lines is turned off, the displacement is maintained. Then, a next scanning line pair is driven and a signal potential is supplied to respective signal lines. If this procedure is repeated, a desired one or ones of sub pixels in one pixel can be opened/closed. In this manner, dither gray scale display can be attained. Therefore, it is possible to send individual image data to each of six sub pixels by properly setting potentials of the signal lines and scanning lines.

Figure 7:
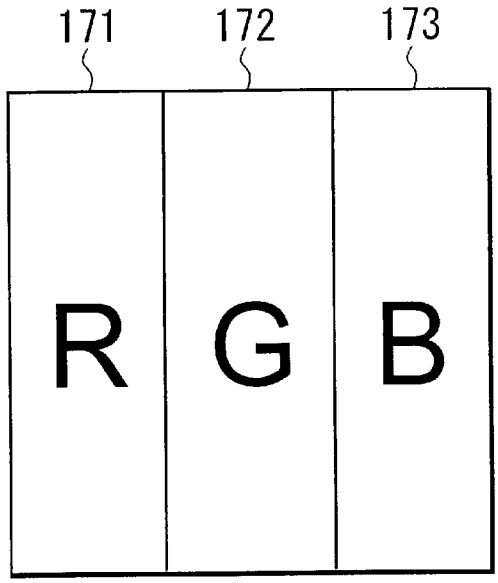
FIG. 7 PRIOR ART
FIG. 7 is a schematic view showing arrangement of color filters in the conventional actuated film display device.
Figure 8:
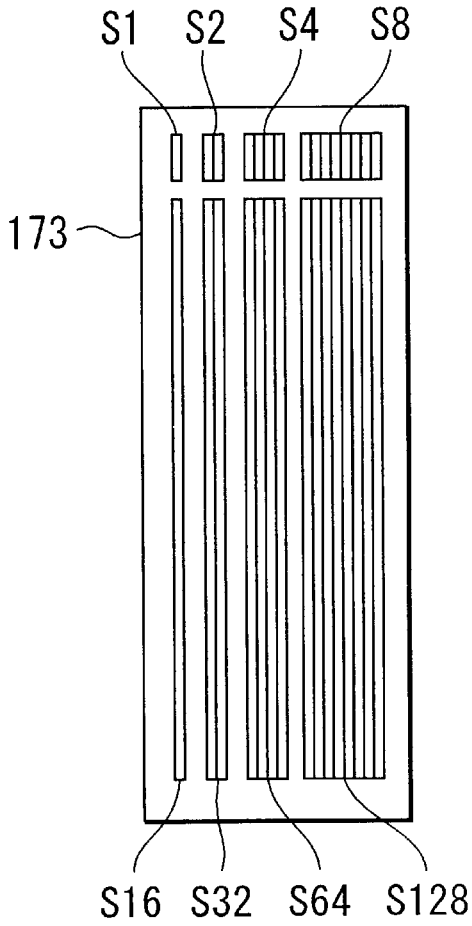
FIG. 8 PRIOR ART
FIG. 8 is a schematic view showing a structure of a pixel arranged under each of the color filters of FIG. 7 and attaining the gray scale display.

FIG. 7 is a pixel of an actuated film display device as viewed from a color-filter side. Reference numerals 171, 172, 173 show the color filters R, G, B, respectively. FIG. 8 is a top view of a pixel under the color filer B. In FIG. 8, there are 8 sub pixels S1–S128. The area ratio of 8 sub pixels are 1:2:4:8:16:32:64:128. Depending upon combinations of the sub pixels to be driven, 256 scales can be formed. If the display device displays 256 scales, it can be employed as a TV screen.

However, when the gray scale is displayed by the above-described display device, numerous signal lines and scanning lines are required to open/close a plurality of sub pixels in one pixel. Therefore, to drive the numerous signal lines and scanning lines, a large number of driving ICs is required. Furthermore, to arrange the large number of driving ICs, the size of the device is inevitably enlarged.

The present invention was made to overcome the aforementioned problems. Hereinafter, embodiments of the present invention will be explained with reference to the drawings.

The actuated film display device of the present invention has the movable film shutters (as shown in FIG. 1) which can be displaced on the basis of the same principle as show in FIG. 2A. These movable film shutters are arranged in the same manner as in FIG. 3. If the movable film shutters are arranged in rows and columns as is in FIG. 4, a matrix-form actuated film display device can be obtained. The wiring of the actuated film display device is carried out in the same manner as in FIG. 5.

First Embodiment

Figure 9:
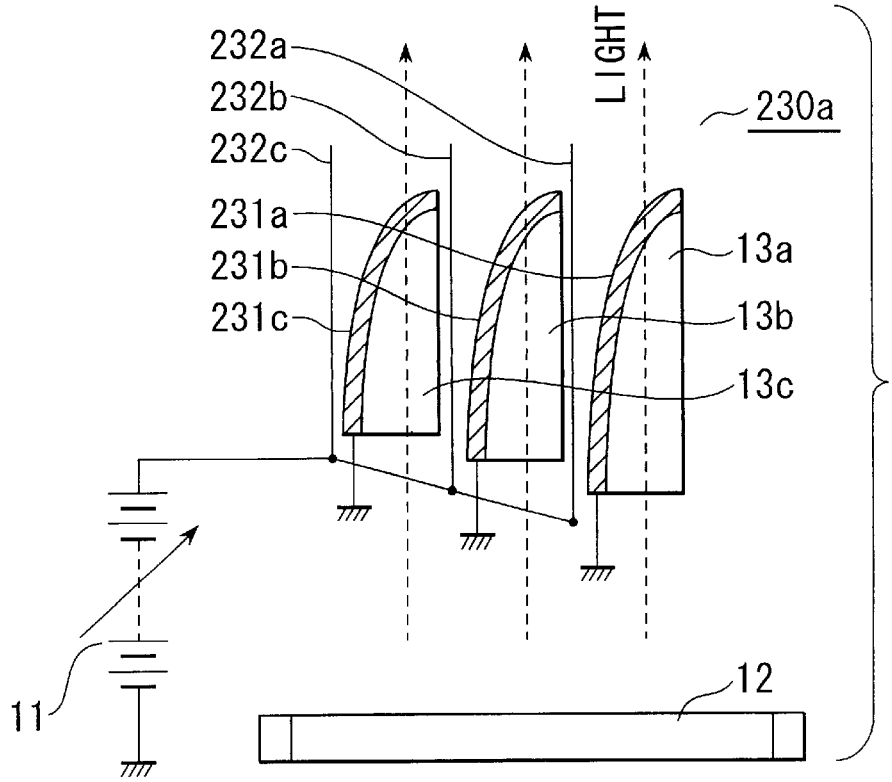
FIG. 9 is a schematic view showing a shutter set corresponding to one pixel of an actuated film liquid crystal display device according to a first embodiment of the present invention.

FIG. 9 shows an optical shutter set corresponding to one pixel of an actuated film display device according to the first embodiment of the present invention. In the actuated film display device of this embodiment, one pixel is formed by using a shutter set 230*a* which is constituted of at least two shutter units 25 different in optical distance.

In the first embodiment, three types of shutter units different in optical distance are prepared. More specifically, the shutter units have movable films different in length and transparent light guiding fixed electrode portions having length values corresponding to the movable films. Each of the transparent light guiding fixed electrode portions 231*a*–231*c* is, for example, grounded. The same voltage is applied to the movable film electrodes 232*a*–232*c* different in length by a variable voltage power source 11. Furthermore, a fluorescent light is used as a light source 12. The light from the light source 12 passes through the transparent light guiding bodies 13*a*–13*c* and goes out in the direction indicated by an arrow.

Note that the movable film electrodes 232*a*–232*c* are formed of polyethylene terephthalate (PET) film of about 12 μm in thickness. Aluminium is deposited in a thickness of about 10–100 nm on both surfaces of the PET film. The aluminium-deposited film is cut into desired sizes by a cutter or a laser beam.

The material of the movable film electrodes 232*a*–232*c* is not limited to the PET film. Polyimide, aramid, polyethylene, polycarbonate and the like may be used as the material.

The transparent light guiding bodies 13*a*–13*c* are formed of polyacetal, polystyrene, liquid crystal polymer or the like and formed by injection molding or stamping. Furthermore, on the surfaces of the transparent light guiding bodies 13*a*–13*c*, a metal such as aluminium, gold, copper, or silver is deposited in a thickness of about 10 to 100 nm. The metal deposited portions act as the transparent light guiding fixed electrode portion 231*a*–231*c*. On the surface of the transparent light guiding fixed electrode portion 231*a*–231*c*, an insulating film (not shown) having a thickness of about 1 to 10 μm is formed by electrodeposition. A black matrix is provided around the outer periphery of the insulating film. The portion on which the insulating film is not attached is an opening portion. Light is emitted from the opening.

In the first embodiment, the movable film electrodes 232*a*–232*c* are set at about 3.5 mm, about 2.5 mm and about 1.5 mm. The transparent light guiding bodies 13*a*–13*c* are formed having length values corresponding to the length values of the movable film electrodes.

Figure 10:
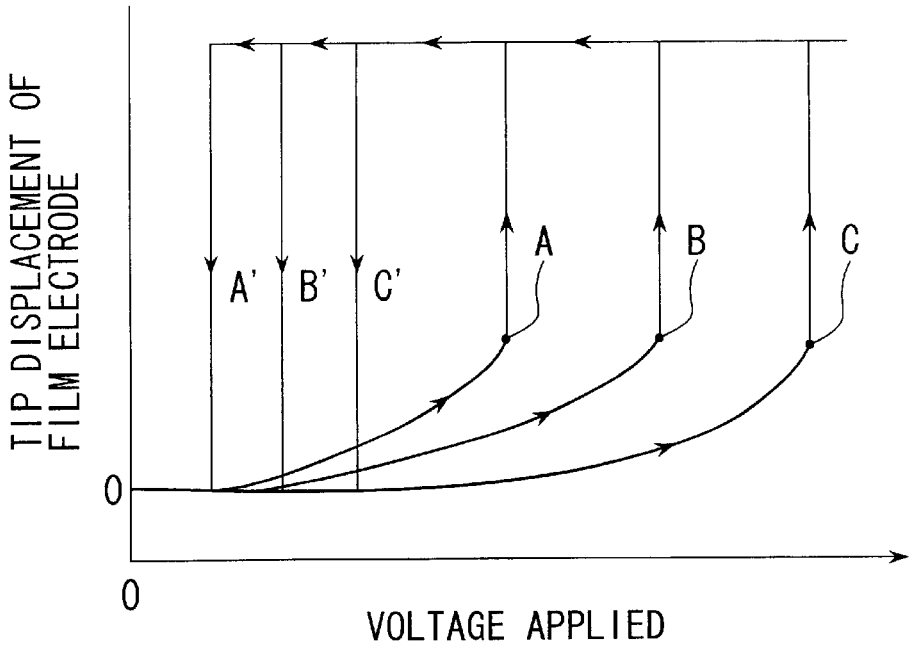
FIG. 10 is a graph showing the relationship between an applied voltage and a tip displacement of a film electrode in the shutter set of FIG. 9.

Now, there will be explained how to operate the actuated film display device of this embodiment. The same voltage is gradually applied to three types of movable film electrodes 232*a*–232*c*. When the voltage reaches critical voltages, each of the tips of the movable films is suddenly displaced, as shown in FIG. 10. In the first embodiment, the critical voltages corresponding to critical points A, B, C (indicated by solid circles) are different with each other. They are about 50V, about 70V, and about 100V. This is because the distance between a fixed end and a movable end varies depending upon pairs of the movable film electrodes 232*a*–232*c* and the transparent light guiding fixed electrode portion 231*a*–231*c*. Accordingly, the respective elastic forces and electrostatic forces differ among them. As a result, the movable film electrodes 232*a*–232*c* are independently and suddenly displaced at different potential differences. In the first embodiment, the longest movable film electrode 232*a* reaches its critical point at the smallest potential difference. Although not shown in the figure, a planar fixed electrode may be arranged at an opposite side of the transparent light guiding fixed electrode portion 231*a*–231*c* with the movable film electrodes 232*a* to 232*c* sandwiched between them. By virtue of the presence of the planar fixed electrode, the displacement of the movable film electrodes 232*a*–232*c* can be more stabilized.

Figure 11:
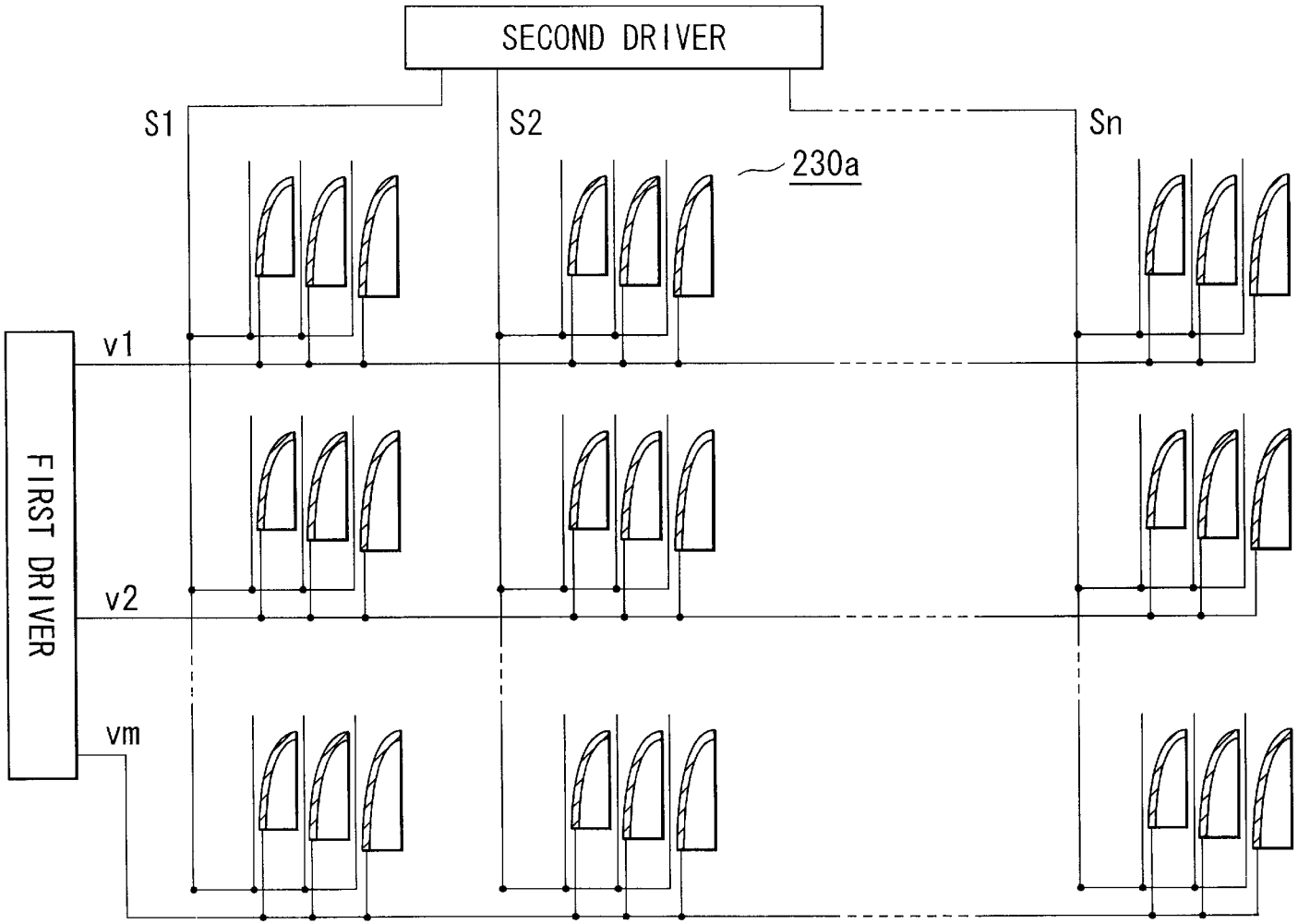
FIG. 11 is a diagram showing how to connect elements of the actuated film display device in which the shutter sets of FIG. 9 are arranged in the form of a matrix.

If the shutter sets 230*a* (shown in FIG. 9) are arranged in the form of a matrix as shown in FIG. 11, an actuated film display device can be constituted. A first signal (scanning signal) v1, v2 . . . vm (m is an integer) is supplied from a first driving circuit to every column of a plurality of shutter sets 230*a* and a second signal (pixel signal) S1, S2 . . . Sn (n is an integer) is supplied from the second driving circuit to every row of the shutter sets 230*a*, in the active matrix type display device. Each pixel can display in accordance with voltage difference between the corresponding scanning signal and pixel signal.

In the actuated film display device of the first embodiment, the number of movable films to be selectively opened/shut can be changed by changing only the voltage to be applied to one pixel. Therefore, it is not necessary to display the gray scale by using numerous signal lines and scanning lines. Accordingly, numerous driving ICs for driving the numerous signals lines and scanning lines are not required, so that cost reduction can be attained and the size of the device can be reduced.

Second Embodiment

Figure 12:
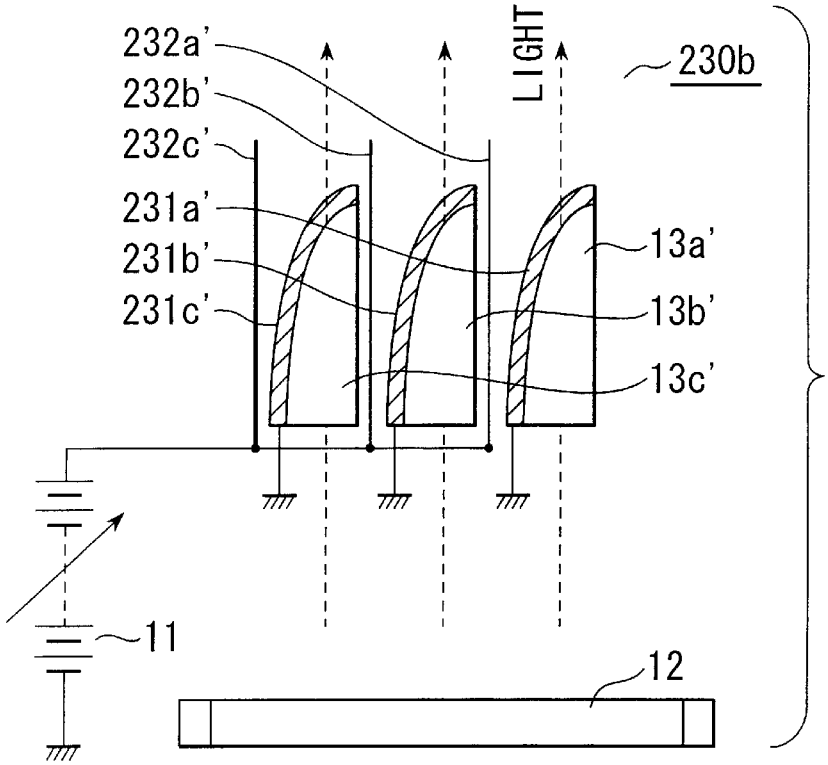
FIG. 12 is a view for explaining the shutter set corresponding to one pixel of an actuated film display device according to a second embodiment of the present invention.

FIG. 12 is a schematic cross-sectional view of a shutter set corresponding to one pixel of the actuated film display device according to the second embodiment of the present invention.

The actuated film display device of the second embodiment is the same as that of the first embodiment in that a plurality of movable film shutter units are arranged in one pixel but differs in that one pixel is formed by using movable film shutter units which have the movable film electrodes of at least two type of thicknesses.

AS shown in FIG. 12, in the shutter set 230*b* of the second embodiment, wiring of transparent light guiding fixed electrode portions 231*a*'–231*c*', transparent light guiding bodies 13*a*'–13*c*', and movable film electrodes 232*a*'–232*c*' is carried out in the same manner as in the first embodiment. The wiring may be formed of the same material in the first embodiment.

However, all movable film shutter units of the actuated film display device of the second embodiment have the same length. More specifically, the length of all the movable film electrodes 232*a*'–232*c*' are set at about 2.5 mm. The width of the movable film electrodes 232*a*'–232*c*' are set at about 6 μm, about 12 μm, and about 18 μm, respectively.

The same voltage is gradually applied to the three types of movable film electrodes 232*a*'–232*c*'. When the voltage reaches a critical point for one of the movable film electrodes, the movable film electrode is suddenly displaced. In this manner, the movable film electrodes are subsequently displaced upon reaching their critical points. In the second embodiment, the critical voltage A, B, C (indicated by solid circles similarly in FIG. 10) differ to each other. They are about 25V, about 70V, and about 160V. This is because the movable film electrodes 232*a*'–232*c*' differ in thickness. Accordingly, the respective elastic forces and electrostatic forces are different, with the result that-the film electrodes 232*a*'–232*c*' are suddenly displaced at different potential differences. Although not shown in the figure, a planar fixed electrode is arranged at the opposite side of the transparent light guiding fixed electrode portion 231*a*'–231*c*' with the movable film electrodes 232*a*'–232*c*' sandwiched between them. By virtue of the presence of the planar fixed electrode, the displacement of the movable film electrodes 232*a*'–232*c*' can be stabilized.

If the shutter sets 230*b* of the second embodiment are also arranged in the form of a matrix as shown in FIG. 11, an active matrix type display device can be constituted.

In the second embodiment, the thinnest movable film electrode 232*a*' reaches its critical point at the smallest potential difference. Therefore, as is the same way as in the first embodiment, it is possible to change the number of movable films selectively opened/shut by changing only the voltage to be applied to one pixel, with the result that no numeral signal lines and scanning lines are required to display the gray scale.

Third Embodiment

Figure 13:
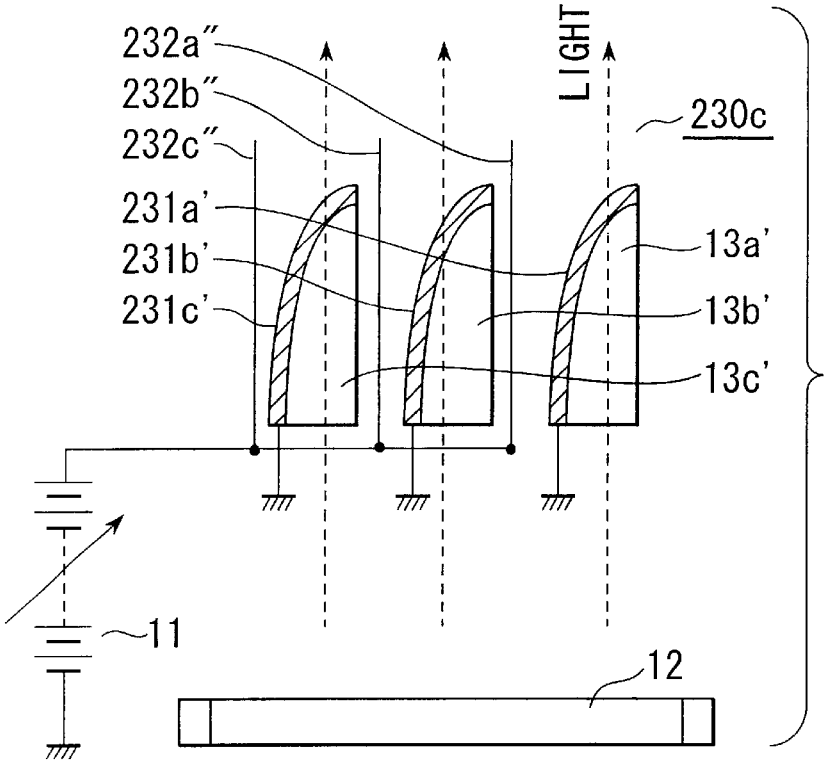
FIG. 13 is a view for explaining the shutter set corresponding to one pixel of an actuated film display device according to a third embodiment of the present invention.

FIG. 13 is a schematic cross-sectional view of a shutter set corresponding to one pixel of the actuated film display device according to a third embodiment of the present invention.

The actuated film display device of the third embodiment is the same as that of the first embodiment in that a plurality of movable film shutter units are arranged in one pixel but differs in that there are at least two kind of distances between the transparent light guiding fixed electrode portion and a fixed end of the movable film electrode in one pixel.

As shown in FIG. 13, in the shutter set 230*c* of the third embodiment, wiring of transparent light guiding fixed electrode portions 231*a*'–231*c*' and transparent light guiding bodies 13*a*'–13*c*' is carried out in the same manner as in the first embodiment. The wiring may be formed of the same material as in the first embodiment.

However, all the shutter units of the actuated film display device of the third embodiment have the same length. More specifically, the length of all the movable film electrodes 232*a*"–232*c*" are set at about 2.5 mm.

The third embodiment differs from the first embodiment in that the distances between the transparent light guiding fixed electrode portions 231*a*'–231*c*' and the fixed ends of the movable film electrodes 232*a*"–232*c*" are set at about 100 $\mu$m, about 50 $\mu$m, and about 0 $\mu$m, respectively. These distances can be set by adhering the transparent light guiding fixed electrode portions 231*a*'–231*c*' to the fixed ends of the movable film electrodes 232*a*"–232*c*" with a spacer such as a tape interposed between them.

The same voltage is gradually applied to the three types of movable film electrodes 232*a*"–232*c*". When the voltage reaches a critical point for one of the movable film electrodes, the movable film electrode is suddenly displaced. In this manner, the movable film electrodes are subsequently displaced upon reaching their critical points. In the third embodiment, the critical voltages corresponding to critical points C, B, A (indicated by solid circles similarly in FIG. 10) are different. They are about 180V, about 110V, and about 70V. This is because the distances between the transparent light guiding fixed electrode portions 231*a*'–231*c*' and the fixed ends of the movable film electrodes 232*a*"–232*c*" differ, and therefore the respective elastic forces and electrostatic forces differ, with the result that the movable film electrodes 232*a*"–232*c*" are displaced suddenly at different potential differences. In the third embodiment, the movable film electrode 232*c*" placed at the shortest distance from the fixed electrode 231*c* reaches its critical point at the smallest potential difference. Although not shown in the figure, a planar fixed electrode is arranged at the opposite side of the transparent light guiding fixed electrode portion 231*a*'–231*c*' with the movable film electrodes 232*a*"–232*c*" sandwiched between them. By virtue of the presence of the planar fixed electrode, the displacement of the movable film electrodes 232*a*"–232*c*" can be more stabilized.

If the shutter sets 230*c* of the third embodiment, are also arranged in the form of a matrix as shown in FIG. 11, an active matrix type display device can be constituted.

Also in the third embodiment, the number of movable films selectively opened/shut can be changed by changing only the voltage applied to one pixel in the same manner as in the first embodiment. Therefore, it is not necessary to display the gray scale by using numerous signal lines and scanning lines.

Fourth Embodiment

Figure 14A:
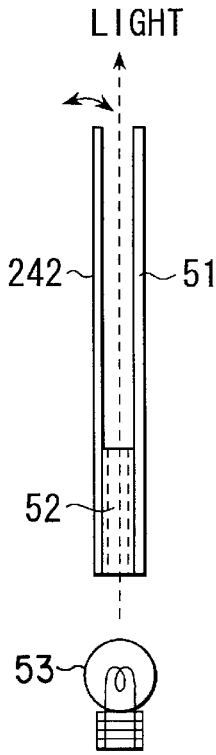
FIGS. 14A and 14B are views for explaining an operational principle of the actuated film display device according to a fourth embodiment of the present invention.
Figure 14B:
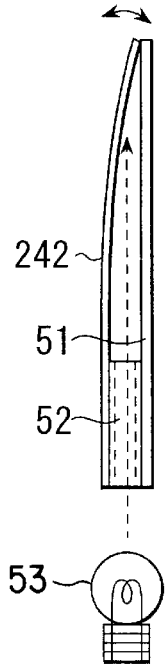

FIGS. 14A and 14B are schematic cross-sectional views for explaining the principal of a shutter unit for use in the actuated film display device according to a fourth embodiment of the present invention.

In the fourth embodiment, the transparent light guiding fixed electrode portion is not formed on the surface of the transparent light guiding body. The shutter unit is formed by using two parallel planer electrodes, namely, a movable film electrode 232, and a fixed electrode 51, as shown in FIG. 14A. More specifically, a support body 52 having a light guiding hole, is formed at a longitudinal end of the space between the movable film electrode 242 and the fixed electrode 51. When no voltage is applied between both electrodes, the light from a light source 53 passes through the hole of the support body 52 and is emitted outside. When the voltage is applied between both electrodes, the movable film electrode 242 bends as shown in FIG. 14B. Therefore, light is shut off. In this case, it is preferable that the inner surface of the movable film electrode 242 facing the fixed electrode 51 and the inner surface of the support body 52 be colored black in order to absorb light.

Figure 15:
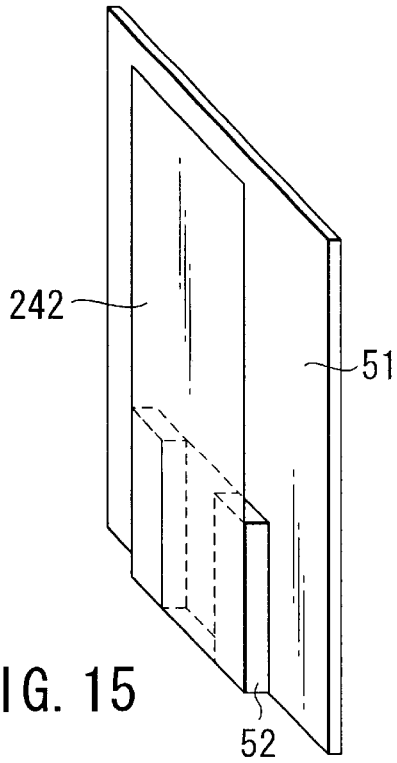
FIG. 15 is a view for explaining the shutter unit of the actuated film display device according to the fourth embodiment of the present invention.

More specifically, the shutter unit of the fourth embodiment is formed of the movable film electrode 242, the fixed electrode 51 and the support body 52, as shown in FIG. 15. The movable film electrode 242 is formed in the same manner and by using the same material as in the first embodiment. The fixed electrode 51 is arranged so as to face the movable film electrode 242 and formed of a hard metal such as stainless or a plastic such as polyester or polyimide. The support body 52 is interposed between both the electrodes, has the light guiding hole, and is formed of plastic such as polyester or polyimide, or ceramic.

Figure 16:
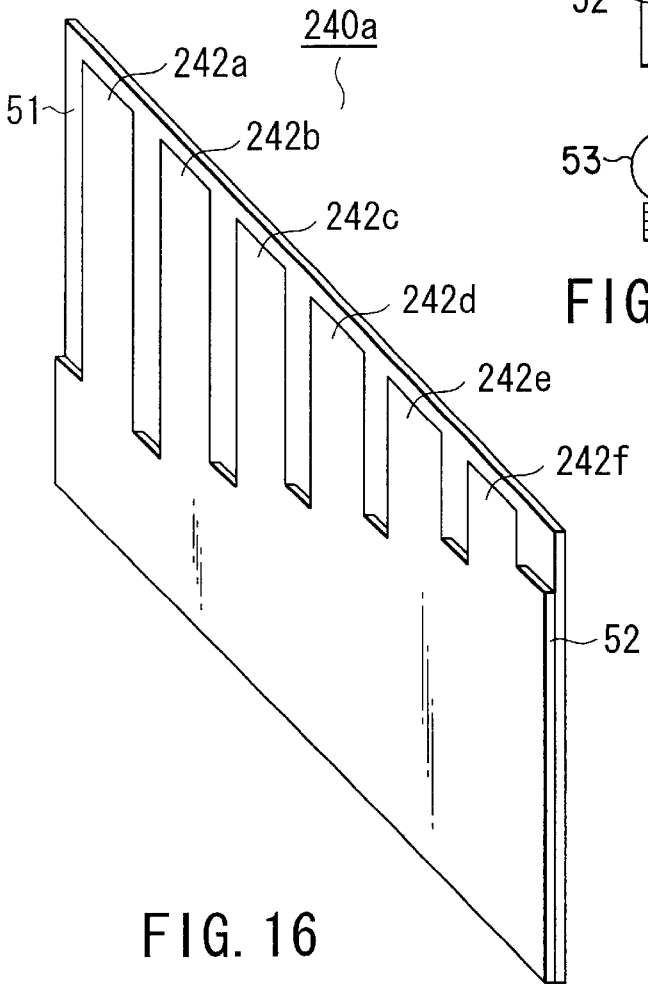
FIG. 16 is a view for explaining the shutter set corresponding to one pixel of the actuated film display device according to the fourth embodiment of the present invention.

One pixel (shutter set 240*a*) is formed by arranging six shutter units in the manner, for example, shown in FIG. 16.

In FIG. 16, the shutter unit has the movable film electrodes 242*a*–242*f* different in length (that is, having six length values). A voltage is applied to the movable film electrodes by a variable voltage source (not shown) in the same manner as in the first embodiment. The fixed electrode 51 is, for example, grounded. Light is applied upwardly from below.

In the fourth embodiment, the length of the movable film electrodes 242*a*–242*f* are set at about 6.5 mm, about 5.5 mm, about 4.5 mm, about 3.5 mm, about 2.5 mm, and about 1.5 mm. The same voltage is gradually applied to the movable film electrodes 242*a*–242*f*. When the voltage reaches a critical point for one of the movable film electrodes, the movable film electrode is suddenly displaced. In this manner, the movable film electrodes are subsequently displaced upon reaching their critical points. In the fourth embodiment, the critical voltages are about 52V, about 55V, about 60V, about 70V, about 90V, about 120V. The reason why the critical voltages differ is that the movable film electrodes 242*a*–242*f* differ in length in the same manner as in the first embodiment, and accordingly the respective elastic forces and electrostatic forces differ, with the result that the positions of the movable film electrodes 242*a*–242*c* are displaced suddenly at different potential differences. In the fourth embodiment, the longest movable film electrode 242*a* reaches its critical point at the smallest potential difference. Although not shown in the figure, a planar fixed electrode is arranged at the opposite side of the fixed electrode 51 with movable film electrodes 242*a*–242*f* sandwiched between them. By virtue of the presence of the planar fixed electrode, the displacement of the movable film electrodes 242*a*–242*f* can be more stabilized.

If the shutter sets 240*a* of the fourth embodiment, are also arranged in the form of a matrix as shown in FIG. 11, an active matrix type display device can be constituted.

Also in the fourth embodiment, the number of movable films selectively opened/shut can be changed by changing only the voltage applied to one pixel in the same manner as in the first embodiment. Therefore, it is not necessary to display the gray scale by using numerous signal lines and scanning lines.

Fifth Embodiment

Figure 17:
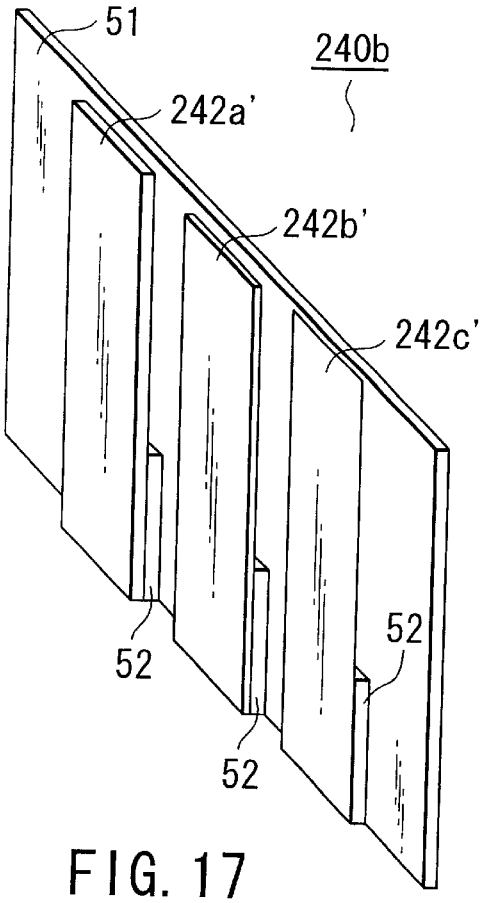
FIG. 17 is a view for explaining the shutter set corresponding to one pixel of the actuated film display device according to a fifth embodiment of the present invention.

FIG. 17 is a schematic perspective view of a shutter set corresponding to one pixel of the actuated film display device according to the fifth embodiment of the present invention. The fifth embodiment is the same as the fourth embodiment in that the shutter unit is formed by using a parallel planer electrode, namely, a movable film electrode and a fixed electrode, but differs in that the shutter set 240*b* corresponding to one pixel is formed by using the movable film electrodes same in length but different in thickness (having at least two thicknesses).

In the fifth embodiment, the fixed electrode 51, the support body 52, the movable film electrodes 242*a*'–242*c*' may be formed of the same materials in the same manner as in the fourth embodiment.

However, all the movable film electrodes 242*a*'–242*c*' have the same length of 2.5 mm. The thicknesses of the electrodes 242*a*'–242*c*' are set at about 18 $\mu$m, about 12 $\mu$m, and about 6 $\mu$m.

The same voltage is gradually applied to the three types of movable film electrodes 242*a*'–242*c*'. When the voltage reaches a critical point for one of the movable film electrodes, the movable film electrode is suddenly displaced. In this manner, the movable film electrodes are, subsequently displaced upon reaching their critical points. In the fifth embodiment, the critical voltages corresponding to critical points C, B, A are different with each other. They are about 180V, about 90V, and about 45V. This is because the movable film electrodes 242*a*'–242*c*' differ in thickness, and therefore the respective elastic forces and electrostatic forces differ, with the result that the film electrodes 242*a*'–242*c*' are displaced suddenly at different potential differences. In the fifth embodiment, the thinnest movable film electrode 242*c*' reaches the critical point at the smallest potential difference. Although not shown in the figure, a planar fixed electrode is arranged at the opposite side of the fixed electrodes 51 with the movable film electrodes 242*a*'–242*c*' sandwiched between them. By virtue of the presence of the planar fixed electrode, the displacement of the movable film electrodes 242*a*'–242*c*' can be more stabilized.

If the shutter sets 240*b* of the fifth embodiment, are arranged in the form of a matrix as shown in FIG. 11, a actuated film display device can be constituted.

Therefore, also in the fifth embodiment, the number of movable films selectively opened/shut can be changed by changing only the voltage applied to one pixel, as in the same way as in the first embodiment. Therefore, it is not necessary to display the gray scale by using numerous signal lines and scanning lines.

Sixth Embodiment

Figure 18:
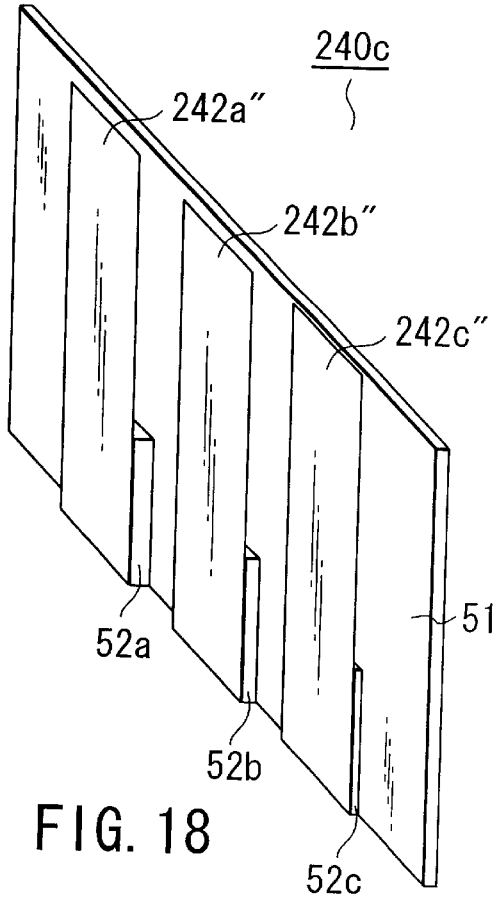
FIG. 18 is a view for explaining the shutter set corresponding to one pixel of the actuated film display device according to a sixth embodiment of the present invention.

FIG. 18 is a schematic perspective view of a shutter set corresponding to one pixel of the actuated film display device according to the sixth embodiment of the present invention. The sixth embodiment is the same as the fourth embodiment in that the shutter unit is formed by using a parallel planer electrode, namely, a movable film electrode and a fixed electrode but differs in that the shutter set 240*b* corresponding to one pixel is formed by setting at least two distances between the fixed electrodes and the fixed ends of the movable film electrodes.

In the sixth embodiment, the fixed electrode 51, support bodies 52*a*–52*c* and the movable film electrodes 242*a*"–242*c*" is formed of the same materials and in the same method as in the fourth embodiment and the wiring of them is carried out in the same manner as in the fourth embodiment.

However, all the movable film electrodes 242*a*"–242*c*" have the same length of about 2.5 mm. The thicknesses of the support bodies 52*a*–52*c*' that is, the distances between the fixed electrodes 51 and the movable film electrodes 242*a*"–242*c*" are about 150 $\mu$m, about 100 $\mu$m and about 50 $\mu$m, respectively.

The same voltage is gradually applied to the three types of movable film electrodes 242*a*"–242*c*". When the voltage reaches a critical point for one of the movable film electrodes, the movable film electrode is suddenly displaced. In this manner, the movable film electrodes are subsequently displaced upon reaching their critical points. In the sixth embodiment, the critical voltages corresponding to critical voltages C, B, A are different with each other. They are about 210V, about 130V, and about 90v. This is because the distances between the movable film electrodes 242*a*"–242*c*" and the fixed electrode 51, differ, and therefore the respective elastic forces and electrostatic forces differ, with the result that the film electrodes 242*a*"–242*c*" are displaced suddenly at different potential differences. In the sixth embodiment, the movable film electrode 242*c* placed at the shortest distance from the fixed electrode reaches the critical point at the smallest potential difference. Although not shown in the figure, a planar fixed electrode is arranged at the opposite side of the fixed electrode 51 with the movable film electrodes 242*a*"–242*c*" sandwiched between them. By virtue of the presence of the planar fixed electrode, the displacement of the movable film electrodes 242*a*" to 242*c*" can be more stabilized.

If the shutter sets 140*c* of the sixth embodiment, are arranged in the form of a matrix as shown in FIG. 11, an active actuated film display device can be constituted.

Therefore, also in the sixth embodiment, the number of movable films selectively opened/shut is changed by changing only the voltage applied to one pixel, as in the same way as in the first embodiment. Therefore, it is not necessary to display the gray scale by using numerous signal lines and scanning lines.

Seventh Embodiment

Figure 19:
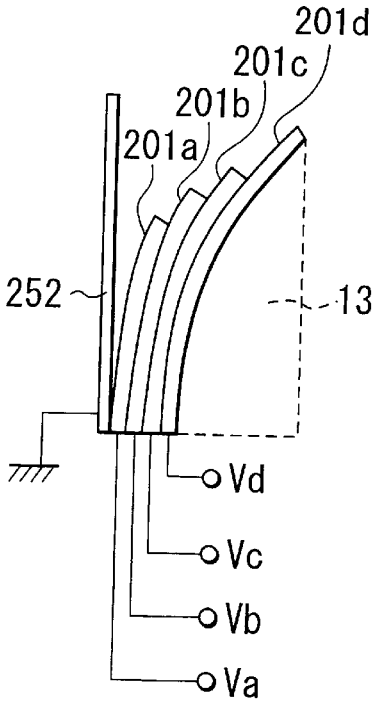
FIG. 19 is a view for explaining the shutter set corresponding to one pixel of the actuated film display device according to a seventh embodiment of the present invention.

FIG. 19 is a schematic cross-sectional view of a shutter unit corresponding to one pixel of the actuated film display device according to the seventh embodiment of the present invention. In the seventh embodiment, different voltages are applied to stacked fixed electrodes 201*a*–201*d*, respectively. Since the bending amount of the movable film electrode 252 is changed based on the respective voltages applied to the stacked electrodes, the light amount passing through the movable film electrode is changed to thereby display gray scale. Therefore, it is possible to form one pixel capable of displaying the gray scale by one shutter unit.

First, the movable film electrode 252 is formed of the same material and in the same method as in the first embodiment. Then, the fixed electrodes 201*a*–201*d* are formed of a conductive material such as gold, copper or aluminium in a thickness of about 10–100 nm. The surface of each of the fixed electrodes facing the movable film electrode 252 is coated, in a thickness of about 10 $\mu$m, with a resin such as polyimide, polyester, nylon or polycarbonate. The fixed electrodes 201*a*–201*d* may be fixed while maintaining a bent form. Alternatively, as shown by a broken line in FIG. 19, the transparent light guiding body 13 is formed in the same manner as in the first embodiment, and then, the fixed electrodes may be formed on the surface of the transparent light guiding body 13.

The movable film electrode 132 is, for example, grounded. To the fixed electrodes 202*a*–202*d*, voltage Va, Vb, Vc and Vd are applied depending upon the display signals. In accordance with the respective potentials to be supplied to the electrodes, the bending amount of the movable film electrode 252 differs. As a result, since the light amount passing through the electrode differs, gray scale can be displayed. In FIG. 19, light is applied upwardly from below. Although not shown in the figure, a planar fixed electrode may be arranged at the opposite side of the fixed electrodes 201*a*–201*d* sandwiching the movable film electrode 252 between them and an appropriate voltage is applied to the electrode. By virtue of the presence of the planar fixed electrode, the displacement of the movable film electrode 252 can be more stabilized.

In the seventh embodiment, the gray scale can be displayed by one shutter unit. Therefore, it is possible to display the gray scale without using numerous signal lines and scanning lines as is the same as in the aforementioned embodiments.

In the above-described embodiments, the present invention is applied to the transmissive display device. However, the present invention is not limited to this, and is also applicable to the reflective display device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An actuated film display device comprising:

a fixed electrode formed by insulatively stacking a plurality of conductive layers different in length, in order of length, while the conductive layers are trued up at one end thereof;

a light-shield movable film electrode, which is placed so as to face a surface of the fixed electrode having the shortest one of the conductive layers uppermost thereon, and which has a fixed end fixed at the one end of the conductive layers and a movable end, the light-shield movable film electrode being displaced toward the conductive layers of the fixed electrode by application of a voltage not less than a critical voltage between at least one of the conductive layers and the light-shield movable film electrode, the critical voltage being different with the respective conductive layers different in length; and a potential supply circuit selectively supplying different potentials of the voltage not less than the critical voltage to the conductive layers of the fixed electrode.

2. The actuated film display device according to claim 1, wherein the fixed electrode has a light guiding portion formed of a transparent material and having a curved surface which faces the movable film electrode and the stacked conductive layers are transparent and formed along the curved surface.

3. The actuated film display device according to claim 2, further comprising an insulating layer covering the conductive layer.

4. The actuated film display device according to claim 1, further comprising a light source arranged at a side of the fixed end of the movable film electrode.

5. The actuated film display device according to claim 1, wherein the fixed electrode and the movable film electrode provide gray scale display in accordance with the potentials applied to the conductive layers.

* * * * *